US010954692B1

(12) United States Patent
Rivera

(10) Patent No.: US 10,954,692 B1
(45) Date of Patent: Mar. 23, 2021

(54) CAR DOOR CLOSING APPARATUS AND METHOD

(71) Applicant: Ramon Rivera, Clayton, NC (US)

(72) Inventor: Ramon Rivera, Clayton, NC (US)

( * ) Notice: Subject to any disclaimer, the term of this patent is extended or adjusted under 35 U.S.C. 154(b) by 0 days.

(21) Appl. No.: 16/875,443

(22) Filed: May 15, 2020

(51) Int. Cl.
*E05B 1/00* (2006.01)
*E05F 11/54* (2006.01)
*E05F 7/00* (2006.01)

(52) U.S. Cl.
CPC ..... *E05B 1/0053* (2013.01); *E05F 7/00* (2013.01); *E05F 11/54* (2013.01); *E05Y 2900/531* (2013.01)

(58) Field of Classification Search
CPC ..... E05F 11/54; E05F 7/00; E05B 1/0069; E05B 1/0053
USPC ..... 16/413, 427, 429, 430, 904, 426; 294/175; 81/15.9
See application file for complete search history.

(56) References Cited

U.S. PATENT DOCUMENTS 584,133 A * 6/1897 McIntire ..... B60N 3/02 105/354
2,610,084 A * 9/1952 Anderson ..... E05B 77/00 49/460
2,677,573 A * 5/1954 Anderson ..... E05B 77/00 49/460
3,764,175 A * 10/1973 Yavitch ..... E05B 85/085 81/484
4,626,016 A * 12/1986 Bergsten ..... B60N 3/02 105/354
4,788,893 A * 12/1988 Sutton ..... B25B 9/00 294/26
4,932,699 A * 6/1990 Hobson ..... B25B 9/00 294/92
4,979,238 A * 12/1990 Clark ..... A47K 13/10 16/422
D325,688 S * 4/1992 Schreib ..... 294/104
5,481,950 A * 1/1996 Browning ..... B25F 1/00 294/24
5,540,468 A * 7/1996 Fassman ..... B65H 75/48 224/162
6,340,189 B1 * 1/2002 Pordy ..... B60N 3/023 16/110.1
6,390,522 B1 * 5/2002 Rucker ..... B65F 1/1405 220/315
7,261,344 B1 * 8/2007 Drake, Jr. ..... E05B 1/0053 292/339
7,309,088 B2 * 12/2007 Fiore ..... E04H 4/1272 294/24
7,478,851 B2 * 1/2009 Geller ..... B25G 1/102 16/413
7,624,966 B2 * 12/2009 Dando ..... E05B 1/0053 254/120
7,744,141 B2 * 6/2010 Saionji ..... B60N 3/023 296/1.02
D624,801 S * 10/2010 Radloff ..... D8/308
(Continued)

*Primary Examiner* — Jeffrey O'Brien
(74) *Attorney, Agent, or Firm* — James G. Passé; Passé Intellectual Property, LLC

(57) ABSTRACT

An apparatus and method for closing a car door from the inside of the car using an elongated handle and a hand mounted on the distal end, which is especially helpful for an aging individual and/or an individual with disabilities to easily close a car door without help from others and without having to exit the vehicle.

4 Claims, 1 Drawing Sheet

(56) References Cited

U.S. PATENT DOCUMENTS

| | | | | |
|---|---|---|---|---|
| 7,938,464 | B1 * | 5/2011 | Hielm | A61F 4/00 294/175 |
| 8,353,546 | B1 * | 1/2013 | Cacas | B25J 1/04 294/24 |
| 8,434,802 | B2 * | 5/2013 | Lofley, Sr. | B25G 1/04 294/210 |
| D711,706 | S * | 8/2014 | Votolato | D8/14 |
| 9,003,928 | B2 * | 4/2015 | Vigil | E05B 19/20 81/15.9 |
| 2002/0184736 | A1 * | 12/2002 | Nelson | E05F 11/54 16/412 |
| 2004/0100109 | A1 * | 5/2004 | Johnson | A47F 13/06 294/26 |
| 2004/0195847 | A1 * | 10/2004 | Cali | B25B 13/48 81/15.9 |
| 2005/0120764 | A1 * | 6/2005 | Warner | E05B 19/20 70/456 R |
| 2007/0289101 | A1 * | 12/2007 | Casteel | E05B 1/0053 16/422 |
| 2009/0000427 | A1 * | 1/2009 | Lacina | E05B 19/20 81/15.9 |
| 2013/0292616 | A1 * | 11/2013 | Kitzman | B66F 15/00 254/120 |
| 2015/0275549 | A1 * | 10/2015 | Lin | E05B 19/20 81/15.9 |
| 2016/0135653 | A1 * | 5/2016 | Reyes | A47K 13/105 4/246.1 |
| 2017/0044795 | A1 * | 2/2017 | Nelson | E05B 1/0053 |

* cited by examiner

CAR DOOR CLOSING APPARATUS AND METHOD

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to an apparatus and method for closing a car door from the inside of the car. In particular, it relates to a device that extends an individual's reach to the car door and can be pulled to close the car door from a seat on the opposite side of the car.

Description of Related Art

When sitting in a car and the door on the opposite side of the car is left open, a person on the inside has to unbuckle their seatbelt and lean and reach across the space in order to close the car door. If the door is sufficiently open, it may be necessary to get out of the car and walk around the outside of the car to close the door. This can be a difficult task if a driver is disabled, or as a driver ages, this can also become an increasingly difficult task.

BRIEF SUMMARY OF THE INVENTION

The present invention relates to an apparatus for reaching across the car interior, grabbing the inside car door handle, and by pulling on the apparatus handle, closing the door that otherwise would be out of reach.

Accordingly, in one embodiment, there is an apparatus for a user closing a car door from the inside of the car by pulling on an inside handle on the car door otherwise out of reach of the user comprising:

a) an elongated handle having a proximal end and a distal end;
b) a hand mounted, essentially perpendicular to the handle on the distal end of the handle; and
c) wherein the hand is coated with a material to reduce scratching of the inside of the car.

In another embodiment, there is a method for a user to close a car door from the inside of the car comprising:

a) selecting an apparatus comprising:
   i. an elongated handle having a proximal end and a distal end;
   ii. a hand mounted, essentially perpendicular to the handle on the distal end of the handle; and
   iii. wherein the hand is coated with a material to reduce scratching of the inside of the car;
b) grasping the elongated handle by the distal end;
c) reaching across the inside of the car and engaging the apparatus hand with a handle on the car door; and
d) pulling on the apparatus handle towards the user until the car door is closed.

DETAILED DESCRIPTION OF THE INVENTION

Figure 1:
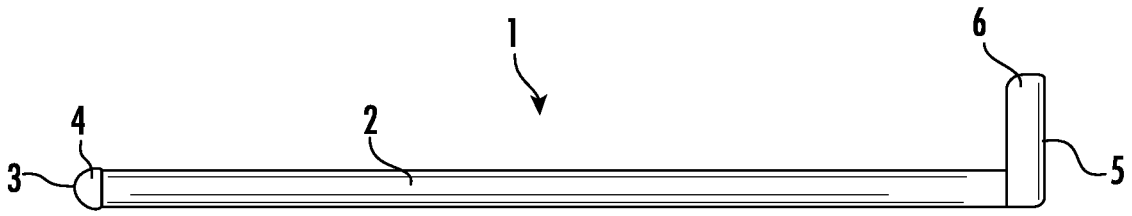
FIG. 1 is a perspective view of the apparatus of the present invention.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "apparatus" refers to a tool or object that can be used to extend the reach of an individual in a car wishing to close a door that is out of reach.

As used herein, the term "user" refers to an individual in a motor vehicle who is going to try to close a car door that is out of reach.

As used herein, the term "closing a car door from the inside of the car" refers to the act of a user sitting inside a motor vehicle, reaching out with the apparatus of the present invention, grabbing an inside handle on the car door that is open with the hand, and pulling on the apparatus to close the door of the car.

As used herein, the term "pulling" refers to a user grabbing the apparatus by its apparatus handle and using the hand to grab the inside handle of the car door and drawing the apparatus towards the user, such that the inside car door handle that has been hooked by the hand will close.

As used herein, the term "inside handle" refers to a handle on a car door that is inside the car when all the doors are closed. It can also refer to an arm rest designed with a pocket opening that can be used to close the car door. This is as opposed to the outside handles on a car door.

As used herein, the term "out of reach of the user" refers to a car door handle being far enough away from a user, such that the user cannot grab the inside handle of the car door in order to close the door. This can be because of the distance of the door, as well as the handle being out of reach due of limited mobility of the user.

As used herein, the term "elongated handle" refers to handgrip, handle, grip, hold, or the like, that is the appendage of the apparatus that is designed to be held in order to use or move it to close a car door. The handle will be at least 18 inches and can be as long as necessary to close a door. In one embodiment, the handle is 24 inches long. The handle can have an adjustable length to adapt the apparatus handle to differing situations. The handle can be wood, plastic, or metal. It can be hollow or solid. In one embodiment, the handle is a plastic, hollow, tube-like material (such as PVC pipe). The handle can have an end cap, grip material, and the like. The proximal end is grabbed by the user, while the distal end of the elongated handle has a hand mounted, essentially perpendicular to the length of the handle.

As used herein, the term "hand" refers to a plate, hook, or the like, mounted at the distal end of the elongated handle, essentially perpendicular to the length of the handle. It is made of a rigid material that will not bend substantially while pulling a car door with the apparatus. In one embodiment, the hand is essentially rectangular but other shapes are contemplated. It is either made of, or coated with a material that will not scratch the car inside such as plastics, leather, vinyl, and the like. In one embodiment, it is a hard rubber.

As used herein, the term "material to reduce scratching of the inside of the car" refers to those materials that the hand can be made of or coated with that minimizes the risk of scratching the inside of the car. Plastics, cloth, leather, vinyl, and the like are examples of such materials.

DRAWINGS

Now referring to the drawings, FIG. 1 is a perspective view of the apparatus of the present invention. In this view, apparatus 1 comprises an elongated handle 2. In this embodiment, a hollow plastic tube is about ¾ of an inch in diameter. At the proximal end 3, there is an end cap 4. The distal end is where a user would grab the inside door handle to utilize the device. At the distal end 5, there is a hand 6 attached essentially perpendicular (90 degrees). In this embodiment, the hand is made of a hard rubber material to prevent scratching of the car interior.

Figure 2:
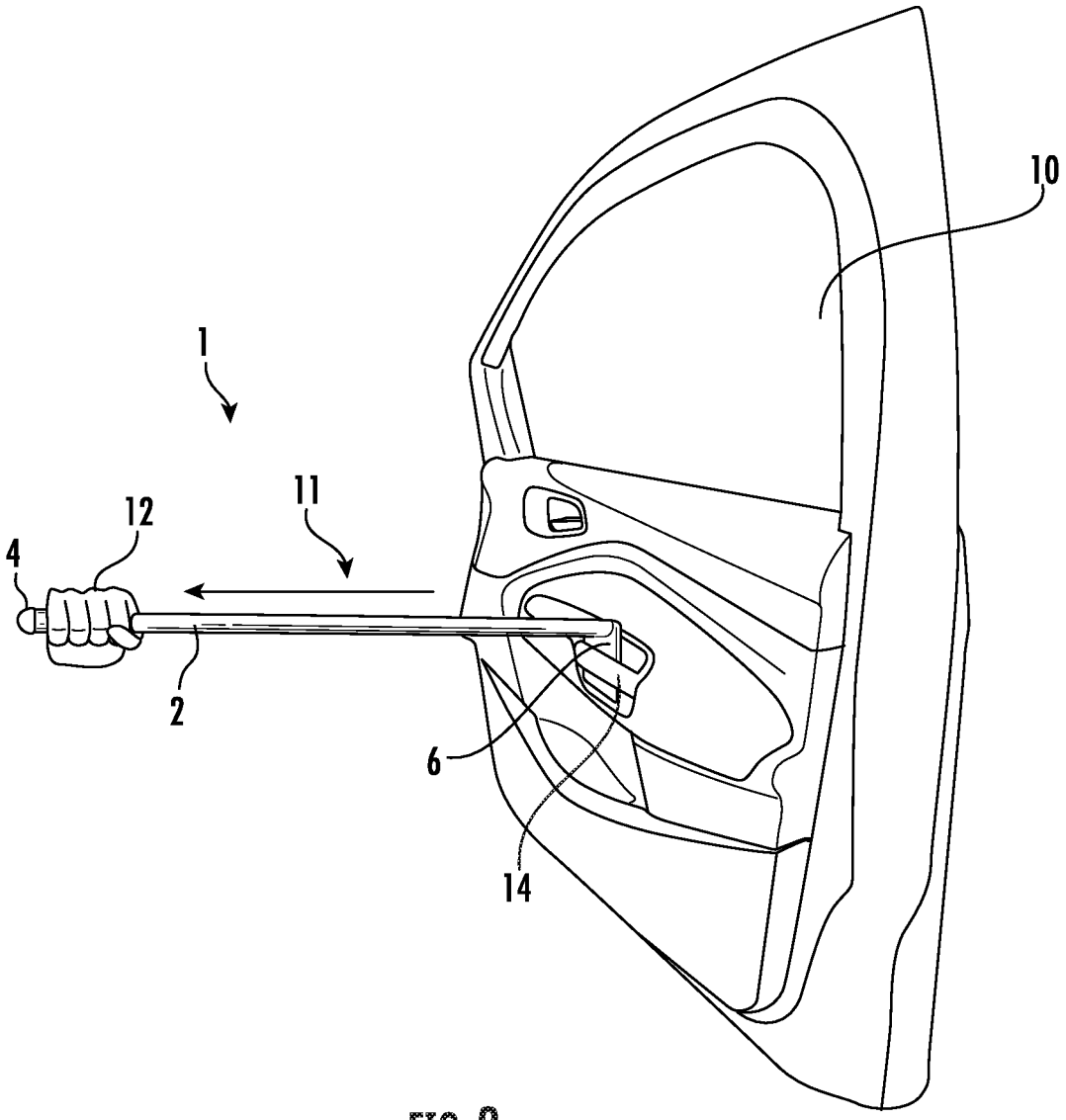
FIG. 2 is a perspective view of using the apparatus to close a car door from the inside of the car.

FIG. 2 is a perspective view of a user 12 pulling the apparatus 1 by the handle 2 in direction 11, thus pulling the otherwise open car door 10 closed by inserting the hand 6 into the inside door handle 14.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. An apparatus for a user closing a car door from the inside of the car by pulling on an inside handle on the car door otherwise out of reach of the user consisting of:

a) a straight, elongated handle having a proximal end and a distal end;

b) a flat plate hand attached directly to the straight elongated handle distal end essentially perpendicular to the straight elongated handle;

c) wherein the hand is coated with a material to reduce scratching of the inside of the car; and d) wherein the proximal end has at least one of an end cap and a grip material.

2. The apparatus according to claim 1 wherein the handle is made of a polymeric material.

3. The apparatus according to claim 2 wherein the polymeric handle is formed into a tube.

4. A method for a user to close a car door from the inside of the car consisting of:

a) selecting an apparatus consisting of:

i. a straight, elongated handle having a proximal end and a distal end;

ii. a flat plate hand attached directly to the straight elongated handle distal end essentially perpendicular to the handle on the distal end of the handle;

iii. wherein the hand is coated with a material to reduce scratching of the inside of the car; and iv. wherein the proximal end has at least one of an end cap and a grip material;

b) the user grasping the elongated handle by the proximal end;

c) reaching across the inside of the car with the apparatus and engaging the apparatus hand with a handle on the car door; and d) pulling on the apparatus handle towards the user until the car door is closed.

* * * * *